US008037794B2

(12) United States Patent
Ridolfi et al.

(10) Patent No.: US 8,037,794 B2
(45) Date of Patent: Oct. 18, 2011

(54) CUTTING MACHINE TO CUT ROLLS OR LOGS OF WEB MATERIAL AND RELATIVE METHOD

(75) Inventors: Quirino Fernando Ridolfi, Lucca (IT); Mario Gioni Chiocchetti, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 176 days.

(21) Appl. No.: 11/921,079

(22) PCT Filed: May 19, 2006

(86) PCT No.: PCT/IT2006/000376

§ 371 (c)(1),
(2), (4) Date: Nov. 27, 2007

(87) PCT Pub. No.: WO2006/126229

PCT Pub. Date: Nov. 30, 2006

(65) Prior Publication Data

US 2009/0038458 A1 Feb. 12, 2009

(30) Foreign Application Priority Data

May 27, 2005 (IT) ..... FI2005A0113

(51) Int. Cl.
*B26D 1/14* (2006.01)

(52) U.S. Cl. ..... 83/174; 73/329; 73/490; 73/508.3

(58) Field of Classification Search ..... 83/174, 83/298, 300, 303, 329, 330, 425.4, 471, 471.1, 83/471.2, 483, 484, 489, 490, 491, 492, 495, 83/498, 499, 504, 508.2, 508.3
See application file for complete search history.

(56) References Cited

U.S. PATENT DOCUMENTS

| | | | | | |
|---|---|---|---|---|---|
| 977,750 | A | * | 12/1910 | Regenold | 83/471.2 |
| 2,207,433 | A | * | 7/1940 | Haswell | 451/420 |
| 3,016,931 | A | * | 1/1962 | Brunkow et al. | 83/157 |
| 3,213,731 | A | | 10/1965 | Renard | |
| 3,467,152 | A | * | 9/1969 | Bradford | 83/663 |
| 4,041,813 | A | | 8/1977 | Spencer | |
| 4,090,424 | A | * | 5/1978 | Hall | 83/330 |
| 4,259,886 | A | * | 4/1981 | Seid et al. | 83/425.2 |
| 4,584,917 | A | * | 4/1986 | Blom | 72/446 |
| 4,640,007 | A | * | 2/1987 | Hydorn | 29/709 |
| 5,038,647 | A | | 8/1991 | Biagiotti | |
| 5,152,105 | A | * | 10/1992 | Belvederi | 451/8 |
| 5,921,162 | A | * | 7/1999 | Jackson et al. | 83/829 |
| 6,123,002 | A | * | 9/2000 | Wunderlich et al. | 83/37 |
| 6,279,441 | B1 | * | 8/2001 | Streblow | 83/75.5 |
| 6,711,978 | B2 | * | 3/2004 | Gambini | 83/471.1 |

FOREIGN PATENT DOCUMENTS

| | | | | |
|---|---|---|---|---|
| EP | 0 335 181 | A1 | | 10/1989 |
| EP | 0335181 | | * | 8/1991 |
| EP | 0 507 750 | A1 | | 10/1992 |
| EP | 0 609 668 | A1 | | 8/1994 |
| EP | 1 175 974 | A2 | | 1/2002 |
| WO | WO 00/21722 | A1 | | 4/2000 |
| WO | WO 01/36151 | A1 | | 5/2001 |
| WO | WO 02/051725 | A2 | | 7/2002 |
| WO | WO 02/051725 | A3 | | 7/2002 |
| WO | WO 2004/004989 | A2 | | 1/2004 |
| WO | WO 2004/004989 | A3 | | 1/2004 |
| WO | WO 2004/039544 | A1 | | 5/2004 |

* cited by examiner

*Primary Examiner* — Edward Landrum
(74) *Attorney, Agent, or Firm* — Breiner & Breiner, L.L.C.

(57) ABSTRACT

The cutting machine includes pairs of coaxial blades to simultaneously cut two rolls for each cutting cycle.

13 Claims, 10 Drawing Sheets

CUTTING MACHINE TO CUT ROLLS OR LOGS OF WEB MATERIAL AND RELATIVE METHOD

TECHNICAL FIELD

The present invention relates to improvements to cutting machines to cut elongated products, in particular rolls or logs of web material, such as tissue paper and the like, wound to produce small rolls intended for packaging and sale.

PRIOR ART

In the paper converting industry, to produce finished articles in the form of rolls or small rolls (such as toilet paper, kitchen towels and the like) paper webs of considerable width, in paper mill reels, are unwound and rewound into rolls or logs of considerable axial length. These logs, which can be several meters in length, are subsequently cut in cutting machines to be divided into small rolls for intended sale and to eliminate the head and tail trimmings Examples of cutting machines for cutting logs or rolls of tissue paper are described in WO-A-2004039544, EP-A-0507750, EP-A-0609668; U.S. Pat. No. 4,041,813. Further cuffing machines of this type are described, for example, in U.S. Pat. No. 3,213,731, U.S. Pat. No. 4,584,917, WO-A-2004004989 and U.S. Pat. No. 5,038,647.

A cutting machine which uses a blade of a particular shape with asymmetrical bevel and different treatments on the two sides of the cutting bevel is described in WO-A-0021722.

One of the critical aspects of these machines is represented by the high and rapid wear of the cutting blades, normally composed of disc knives provided with an orbital movement, that is, a movement along a closed path or trajectory. The characteristics of the paper material to be cut and the high cutting speeds cause rapid blunting of the blades, which must consequently be frequently sharpened by sharpening units assembled on the machines.

One of the prevailing factors having a negative influence on wear of the blades is represented by the orbital rotation speed of the blades and consequently by the high speed with which these blades strike the material to be cut.

OBJECTS AND SUMMARY OF THE INVENTION

An object of the present invention is to produce a cutting machine for cutting elongated products, in particular although not exclusively rolls or logs of paper, such as tissue paper, to produce small rolls, in which it is possible to decrease wear of the blades and consequently increase the duration thereof, without negative effects in terms of production speed.

This and other objects and advantages, which will be apparent to those skilled in the art by reading the text hereunder, are obtained in substance with a cutting machine for cutting and dividing elongated products into articles of a specific length (e.g. to cut logs into individual rolls or small rolls), comprising at least one cutting tool moving cyclically along a closed path, e.g. cyclically orbiting according to an elliptical or circular orbit, and rotating about its own axis of rotation, wherein the cutting tool comprises at least two disc blades having a common axis of rotation and spaced apart by a length equivalent to the length of the articles obtained from cutting the elongated products.

The cutting tool can be provided with an orbiting motion along a circular trajectory about a main rotation axis. In substance, the cutting tool or tools, each comprising at least one pair of coaxial disc blades, that is, with a common axis of rotation (or with two separate axes coaxial with each other), are supported by an element rotating about a main axis. However, this is not the only possible configuration of a cutting machine according to the invention. In fact, the cutting tool with two blades could be supported by a pivoting arm that imparts, to the axis of rotation of the two blades forming the cutting tool, an orbital movement along a cyclic orbit, substantially elliptical in shape, according to configurations known to those skilled in the art.

The coaxial blades (i.e. supported rotatingly about a common axis of rotation) of each tool can have a conical section delimited by two faces: a first flat face and a second conical face. When the blades have this configuration, each pair of blades is assembled so that the flat surfaces of the two blades are facing each other, while the two conical surfaces are facing the outside of the pair of disc blades forming the single cutting tool. In this way it is possible to obtain advantages in terms of stress on the blades and on the product to be cut. However, it would also be possible to position the disc blades in the opposite way or mixed, i.e. with the faces with a conical surface facing each other, or with the conical face of one blade facing the flat face of the other blade. The most suitable reciprocal position of the blades is chosen as a function of the type of product to be cut (compactness, distance between cuts, product diameter, presence or absence of a central winding core and composition thereof, etc.), of the material of the disc blades, the cutting frequency and other machine parameters, with the principal objective of obtaining cuts which are as uniform as possible and orthogonal to the axis of the products to be processed.

According to a possible embodiment of the machine according to the invention, the distance between the coaxial disc blades is adjustable to adapt the machine to different cutting lengths of the individual articles obtained by dividing elongated products.

Further advantageous features and embodiments of the cutting machine according to the invention are indicated in the appended claims.

The invention also relates to a method for cutting elongated products, such as logs of wound web material, into articles of a specific length by means of an orbiting cutting tool, characterized in that the orbiting cutting tool comprises two coaxial disc blades spaced apart by a length equivalent to the length of the individual articles into which the elongated products are divided.

Further advantageous features of the method according to the invention are indicated in the appended dependent claims and will be described in greater detail with reference to an embodiment illustrated in the accompanying drawings.

BRIEF DESCRIPTION OF THE DRAWINGS

The invention will be better understood by following the description and accompanying drawing, which shows a non-limiting practical embodiment of the invention. More specifically, in the drawing.

DETAILED DESCRIPTION OF A PREFERRED EMBODIMENT OF THE INVENTION

Figure 1:
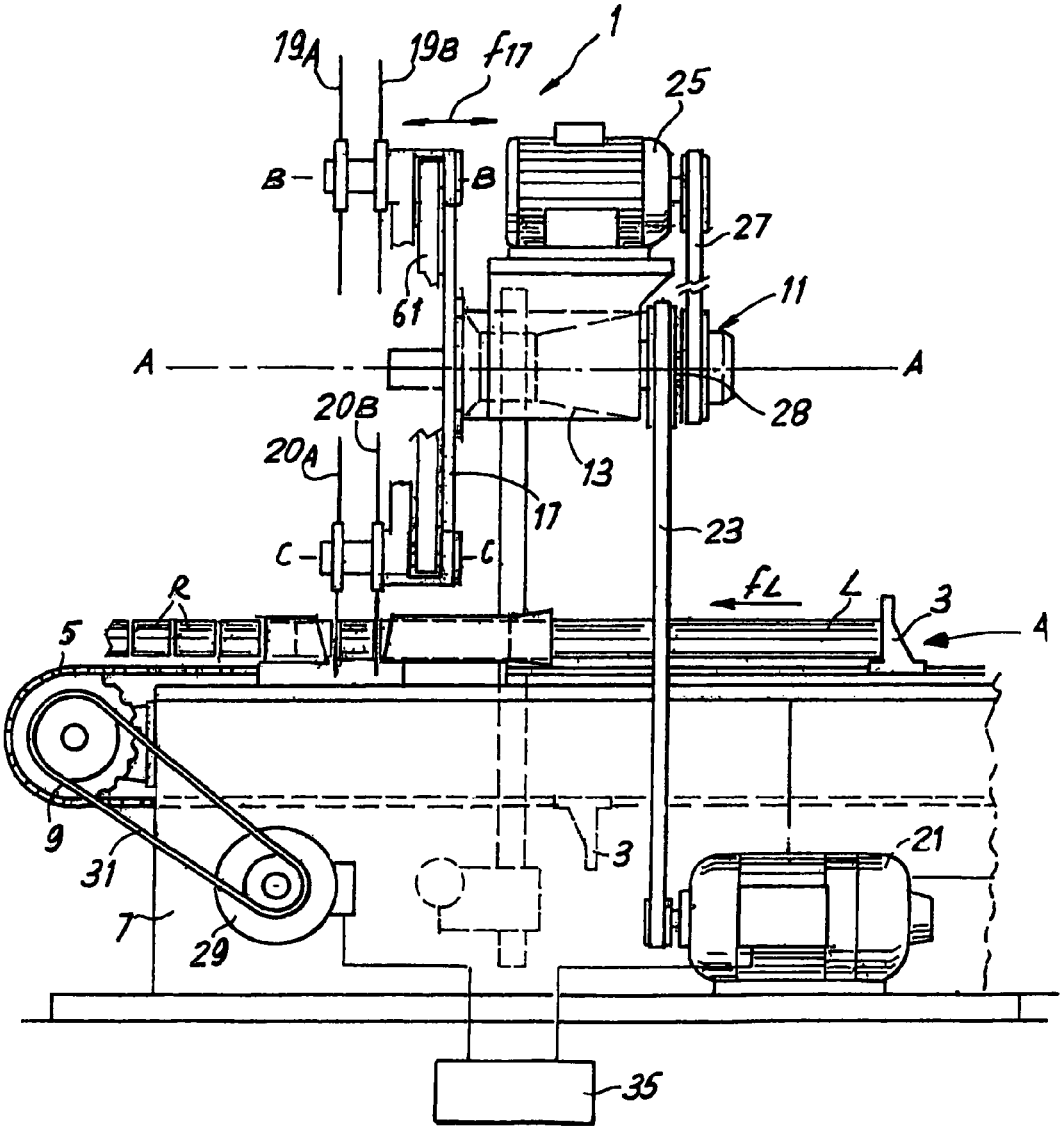
FIG. 1 shows a schematic side view of the front part of the cutting machine.
Figure 2:
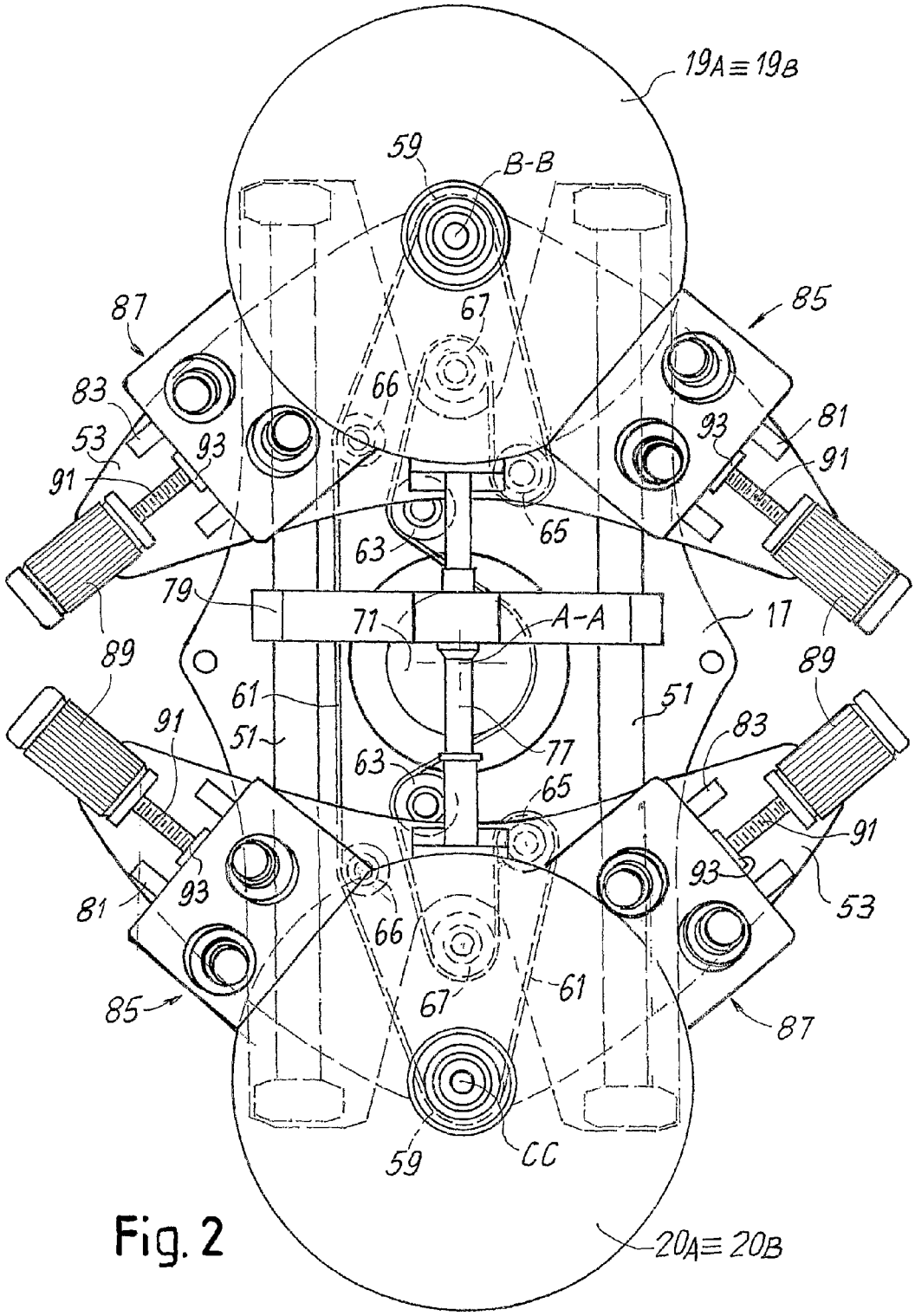
FIGS. 2 and 3 respectively show a rear and a front view of the cutting head, the front view being devoid of the members to transmit motion to the blades.

FIG. 1 schematically shows (limited to the front part thereof) a possible embodiment of a cutting machine incorporating the invention, indicated as a whole with 1. The machine has a feed path or channel 4 of the logs to be cut, indicated with L, which are pushed by feed members or pushers 3 constrained to a chain-type or similar flexible member 5, driven about transmission wheels supported by a fixed structure 7. In FIG. 1 only one transmission wheel, indicated with 9, is visible, while the other is at the rear end of the cutting machine, not shown. Actually, as can be seen clearly from FIG. 2 and known from prior art, the flexible members 5 are more than one, in parallel, to feed several logs L according to parallel paths. In the example in FIG. 2, one feed channel is shown. Four channels can be provided for simultaneous feed of four adjacent logs L.

The flexible members 5 associated with the various parallel feed channels of the logs can be motorized separately from each other to stagger the movement of the logs in the individual feed channels.

A cutting head, indicated generically with 11, by means of a support 13 supports a rotating element 17. The element 17 rotates about a horizontal axis A-A parallel to the direction fL of feed of the logs L. Two pairs of disc blades 19A, 19B and 20A, 20B are assembled on the rotating element 17, positioned at 180° from each other about the axis A-A, as can be seen in particular in FIG. 2. The two rotating disc blades 19A, 19B and 20A, 20B of each pair rotate about their own axis of rotation B-B and C-C parallel to the axis A-A and to the direction of feed fL of the logs L.

A motor, indicated generically with 21, by means of a belt 23 transmits the rotational motion to the rotating element 17. A second motor 25 is positioned on the support 13 of the rotating element 17, and, by means of a belt 27, provides the rotational motion to a shaft 28 which, through a transmission to be described hereunder, makes the rotating disc blades 19A, 19B and 20A, 20B rotate. A third motor 29, by means of a belt 31, makes the transmission wheel 9 of the rotating member 5 rotate. As mentioned above, as there can be several parallel channels for feed of the logs L that are cut separately to form the rolls R, a transmission wheel 9 with its own motor 29 suitably controlled as a function of the angular position of the rotating element 17, can be associated with each channel. A programmable control unit, indicated with 35, synchronizes the feed movement of the flexible member or members 5 by means of the motor or motors 29 with the angular position of the rotating element 17 by controlling the motor 21.

Figure 2A:
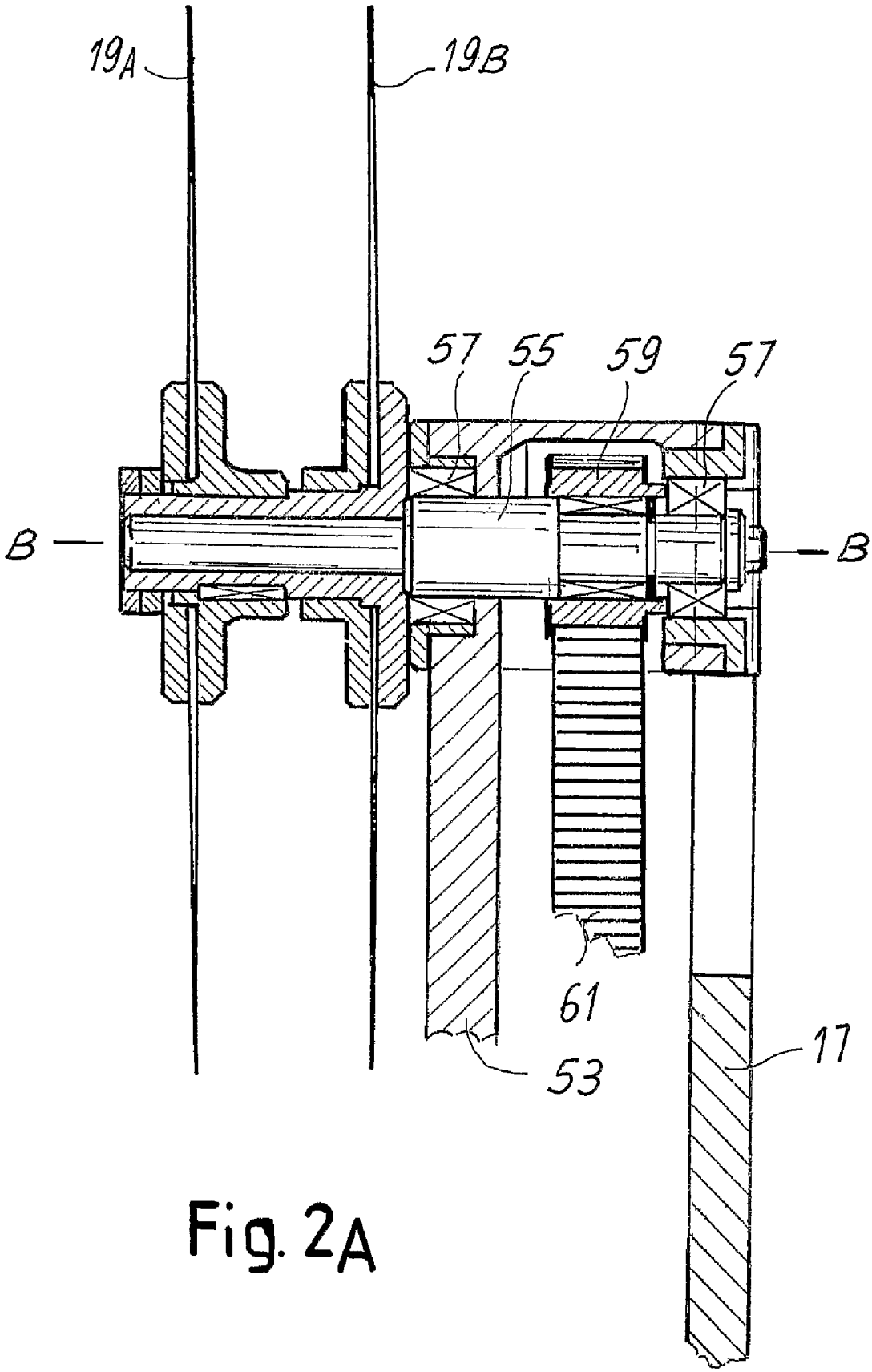
FIG. 2A shows an axial section of a detail of the assembly of a pair of coaxial blades.
Figure 3:
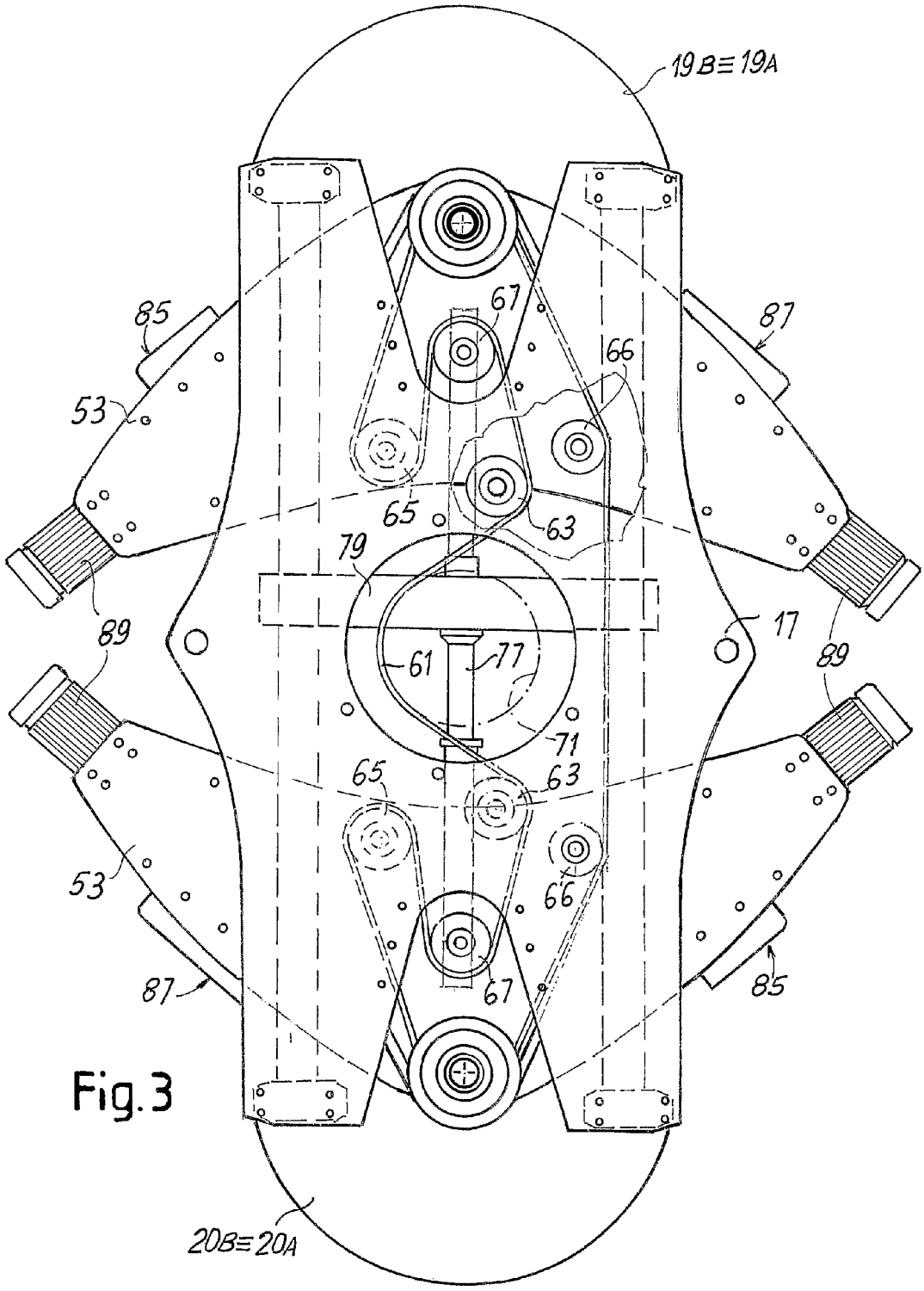
Figure 4:
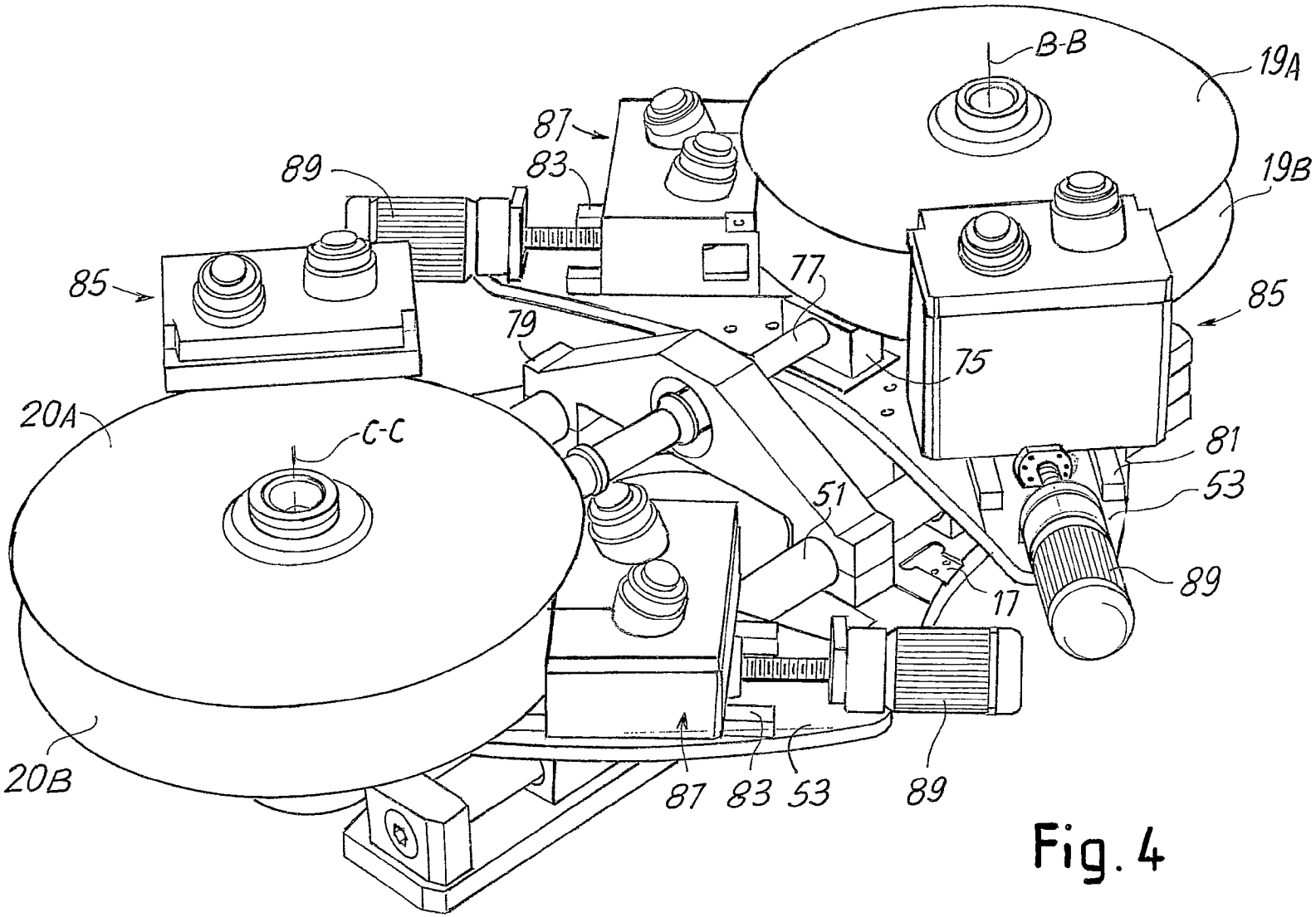
FIGS. 4 and 5 show axonometric views according to two different angles of the cutting head, devoid of members for transmitting motion to the blades.
Figure 5:
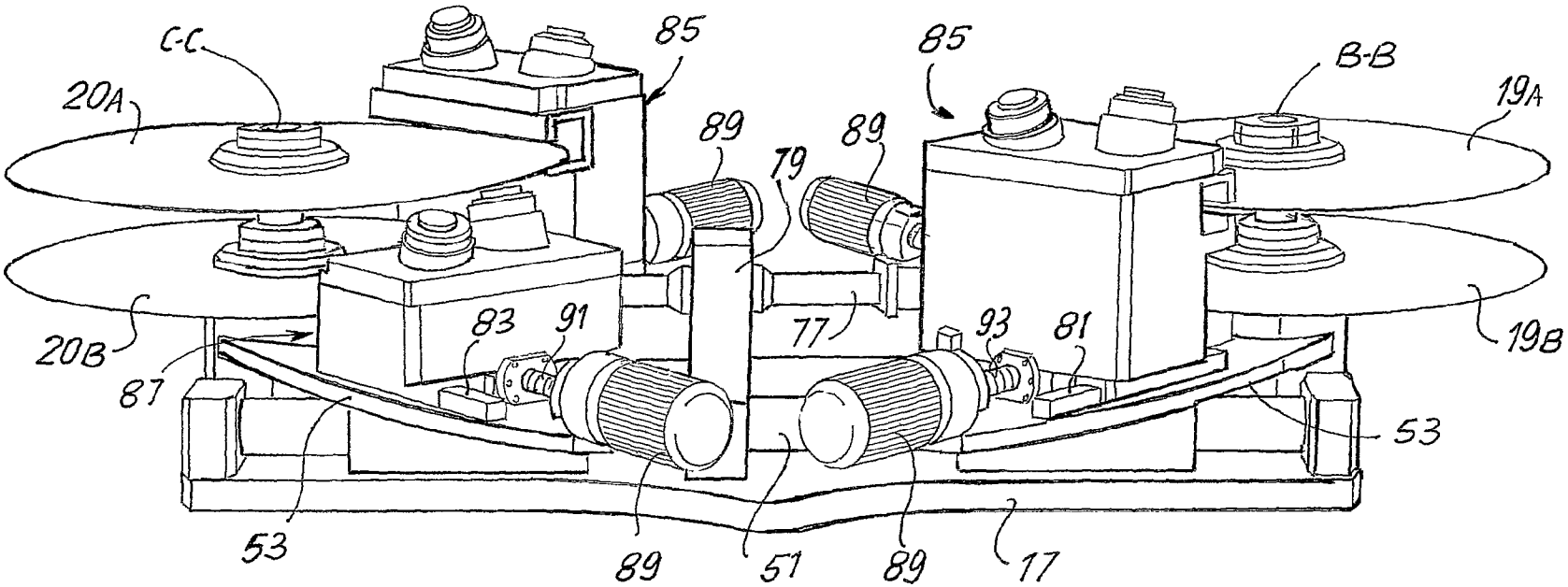
Figure 6:
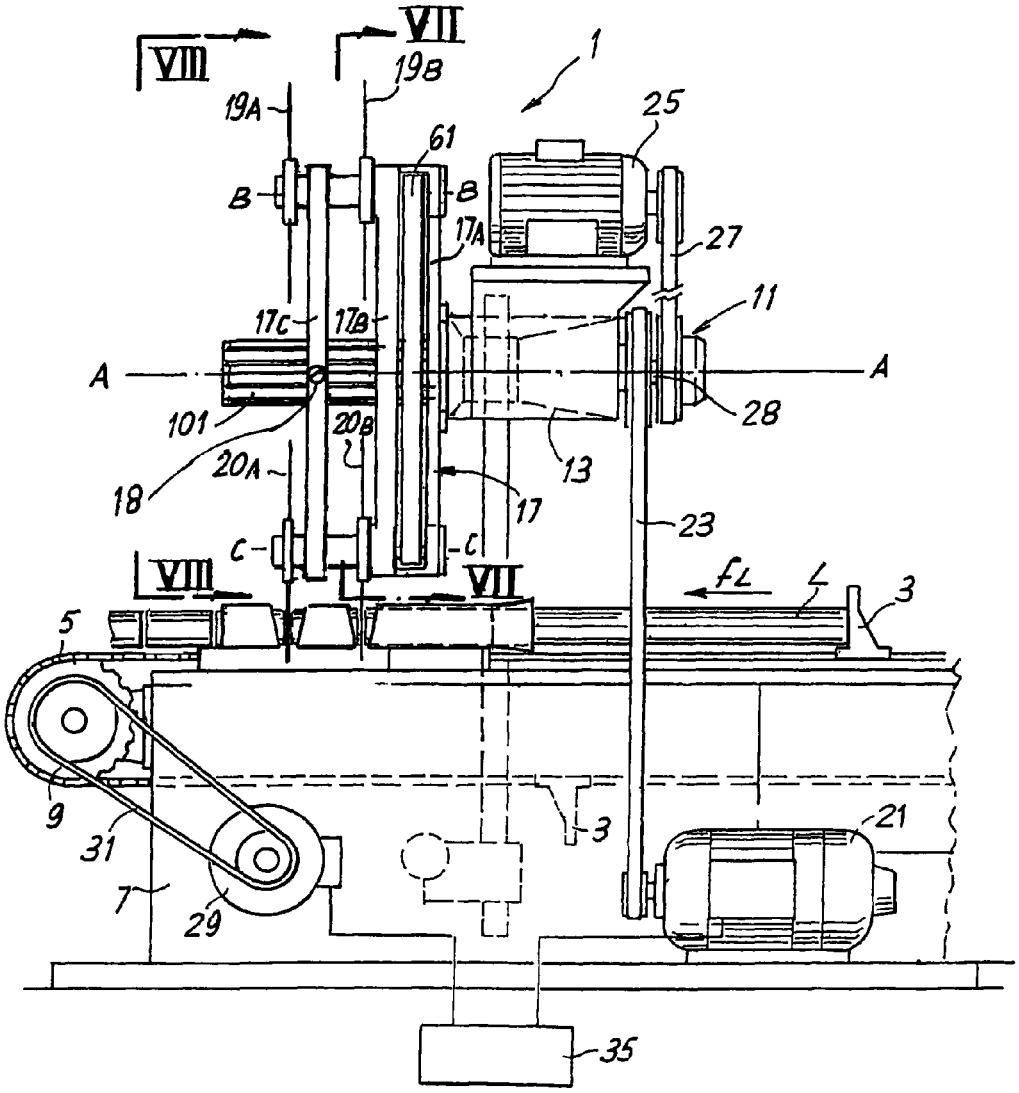
FIG. 6 shows a schematic side view of a front part of the cutting machine in a modified embodiment.
Figure 7:
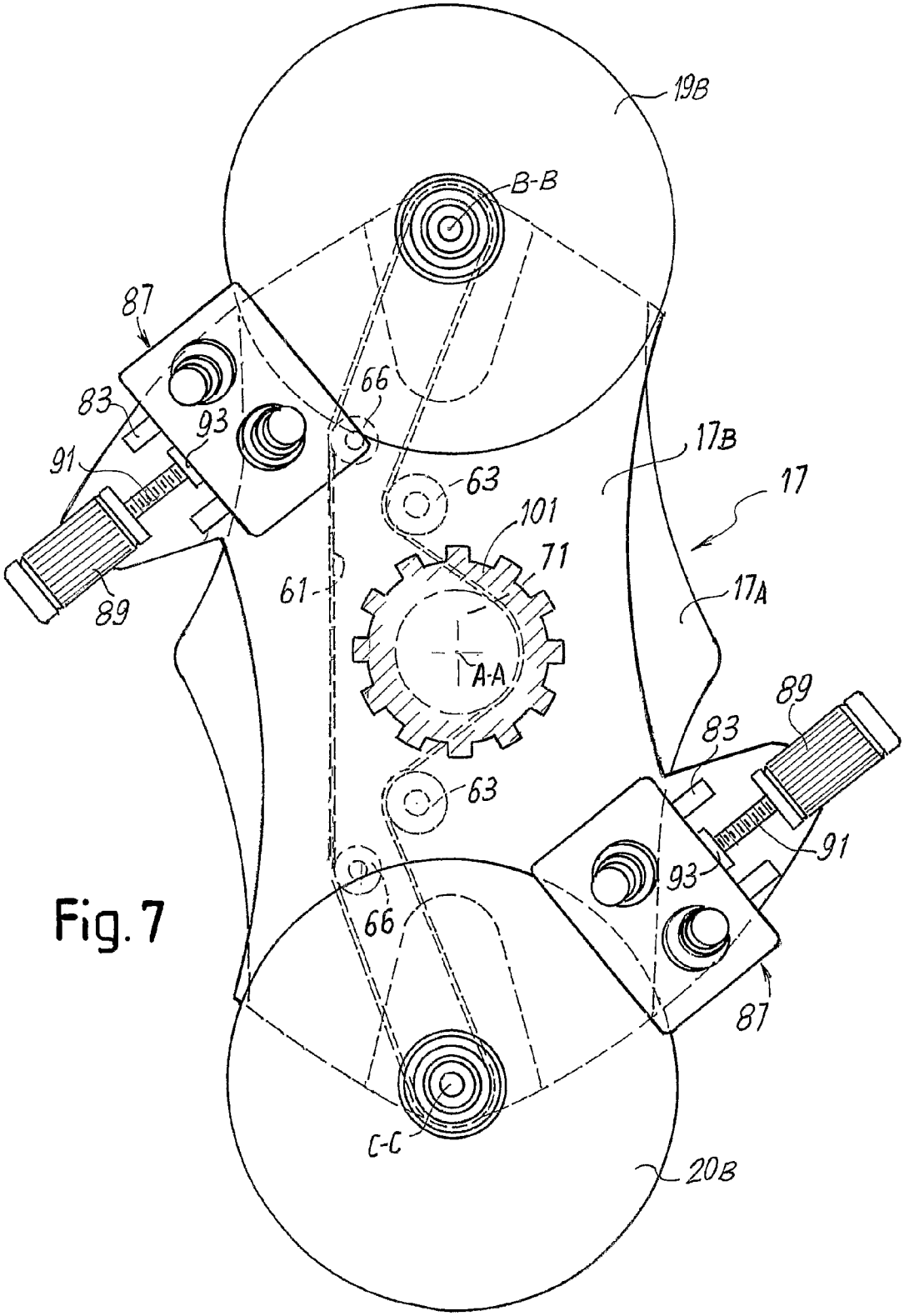
FIG. 7 shows a view according to VII-VII in FIG. 6.
Figure 8:
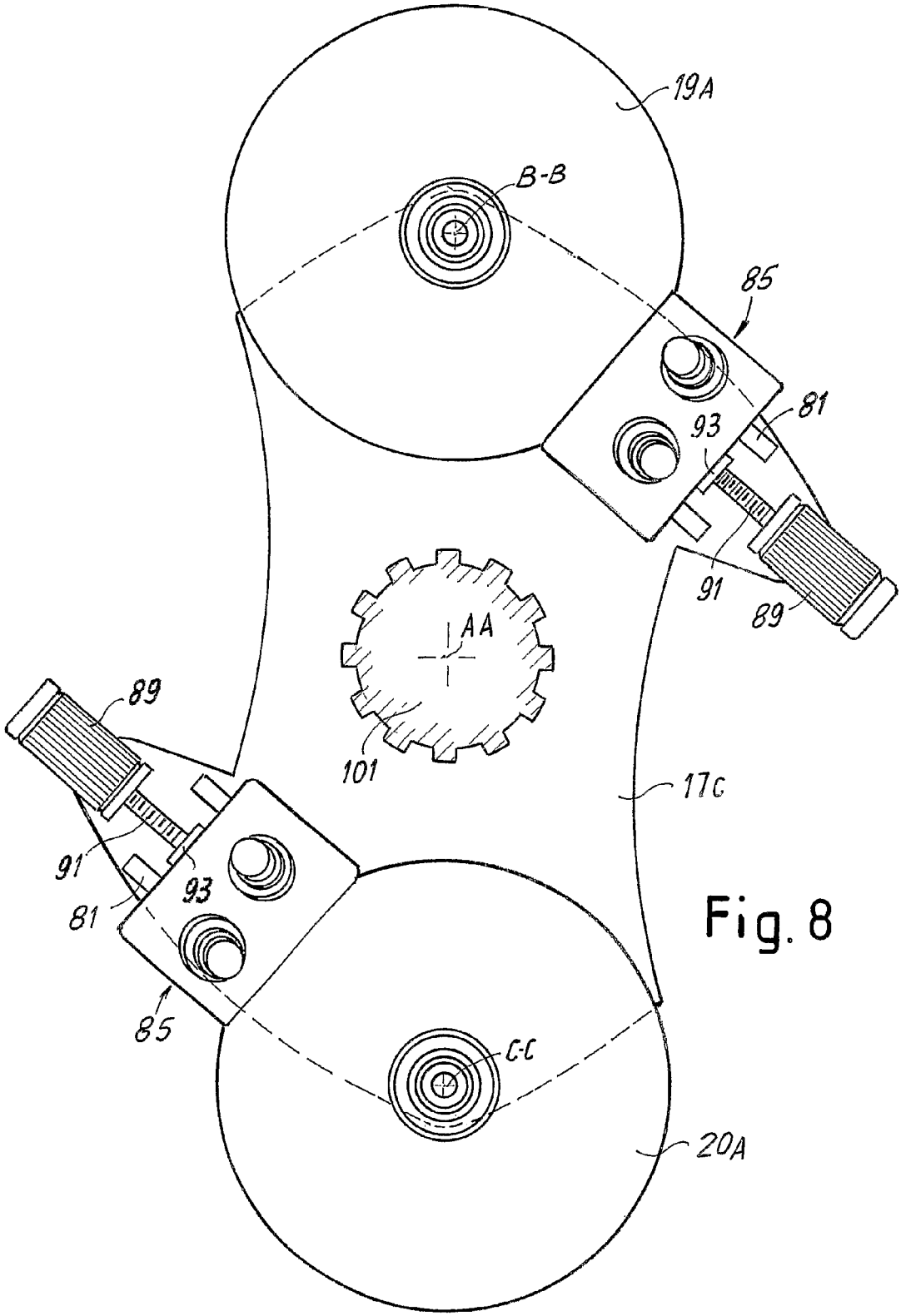
FIG. 8 shows a view according to VIII-VIII in FIG. 6.

The cutting head is shown in greater detail in FIGS. 2 to 5. Fixed on the rotating element 17 are two guide bars 51 extending parallel to a plane orthogonal to the principal axis of rotation A-A of the rotating element 17. In this embodiment, two principal slides 53 slide on said guide bars, each of which supports an axle 55 (FIG. 2A) supported by bearings 57. Two respective disc blades, indicated with 19A, 19B and 20A, 20B respectively for the two axles 55, are keyed onto each of the two axles 55. The blades are assembled as shown in the detail in FIG. 2A, which shows assembly of the blades 19A, 19B, the blades 20A, 20B being assembled in a substantially equivalent way.

Keyed onto each of the axles 55 is a toothed wheel 59, around which a toothed belt 61 is entrained, in turn entrained about a toothed wheel 63 supported by the rotating element 17 and toothed wheels 65, 67, supported by the respective slide 53. The toothed belt 61 is also driven about a central toothed wheel 71, keyed onto the motor shaft 28 with axis A-A. By means of the belt 61, the toothed wheel 71 thus provides the rotational motion to both pairs of blades 19A, 19B and 20A, 20B.

The slides 53 are provided with respective female screws 75, engaging in which are the threaded ends with opposed threads of a bar 77 supported centrally, and associated with which is a gear motor supported by a bracket 79 integral with the rotating element 17 and not shown for greater clarity of the drawing. Rotation of the bar 77 causes a sliding movement along the guide bars 51 in opposite directions of the slides 53 to take up wear of the blades 19A, 19B and 20A, 20B, said wear being caused by the sharpening operations required due to the blunting action of the blades by the material of which the logs L are formed.

Each slide 53, which has an overall V-shaped configuration, supports two pairs of guides 81, 83 for respective sharpening units 85, 87. Each sharpening unit comprises a pair of inclined grinding wheels, each acting on a respective side of the blade with which the sharpening unit is associated. The structure of each sharpening unit can, for example, be of the type illustrated in WO-A-0136151 (which corresponds to U.S. Pat. No. 6,786,808 B1 and which is incorporated by reference), U.S. Pat. No. 4,041,813 or also in WO-A-2004039544 (which corresponds to U.S. Patent Application Publication No. 2006/0011015 A1 which is incorporated by reference).

The structure of the sharpening units is not binding and, in any case, known per se and therefore not described in greater detail herein. It is sufficient to mention that the sharpening units 85, 87 associated with the blades 19A, 19B or 20A, 20B assembled on the axis B-B or C-C are staggered along the direction of the axes B-B and C-C by a distance equivalent to the distance between the blades 20A, 20B or 19A, 19B. Moreover, each sharpening unit 85, 87 is gradually advanced along the guides 83, 81 supported by respective slides 53 to move gradually towards the axis B-B or C-C on which the blades 19A, 19B or 20A, 20B are assembled. This movement, imparted by the respective stepping motor 89, by means of threaded bars 91 engaging in female screws 93 integral with the sharpening units 85 or 87, makes it possible to take up wear of the blades and therefore keep the grinding wheels of the sharpening units always in the correct position with respect to the bevel of the blades. The same movement imparted by the stepping motors 89 can also take the grinding wheels, which must act on the blades with an intermittent sharpening operation, to the operating position and to the idle position. Alternatively, and in a manner known per se, movement of the grinding wheels towards and away from the blades is obtained by means of actuators supported by the sharpening units 85, 87, an actuator being provided for each grinding wheel of each sharpening unit.

The device described above operates as follows. The motor 29 feeds the logs L to be cut with a predetermined law of motion, (i.e., advancement movement) by means of pushers 3 fixed to the flexible members 5. The motor 21 makes the rotating element 17 rotate about axis A-A to cyclically take one or other of the two pairs of disc blades 19A, 19B or 20A, 20B to cut the logs fed in the respective channel below.

In a way known per se, (see, for example EP-A-0507750 which corresponds to U.S. Pat. No. 5,315,907, the U.S. patent being incorporated herein by reference) the whole rotating element 17 can be provided with an alternate motion parallel to the axis A-A, obtained by means of a cam device as a consequence of the same rotation imparted by the motor 21 about the axis A-A. The alternate movement parallel to the direction of feed fL of the logs L is synchronized with the angular position of the pairs of blades so that during cutting (i.e., while a pair of blades is in contact with the material of the logs L) these move forward with a speed equivalent to the feed speed of the rotating element 17. Vice versa, when the blades 19A, 19B and 20A, 20B are disengaged from the rolls or logs L the rotating element 17 is moved back. This movement makes it possible to obtain certain advantages known to those skilled in the art and described in EP-A-0507750.

With each rotation through 360° of the rotating element, the two pairs of blades 19A, 19B and 20A, 20B perform four cuts in each of the logs L fed along the feed channels, producing for each log four small rolls R. As a result, with a pair of axes B-B and C-C on each of which two rotating disc blades are supported, the cutting machine according to the invention has double the productivity compared to conventional machines, in which a single disc blade is supported on each axis B-B and C-C, at the same rotation speed of the rotating element 17 about the axis A-A.

On the other hand, this makes it possible to reduce the rotation speed of the rotating element 17 about the axis A-A considerably, without reducing machine productivity and consequently obtain a more regular cut and less stress to the material of which the logs are composed, with consequent advantages as defined above.

It must be understood that similar advantages can be obtained applying the principal of the present invention also to machines with different structures. For example, the rotating element 17 can be devoid of the reciprocating movement according to the double arrow f17 (FIG. 1) and the logs L can be fed with intermittent motion, holding them still during the cut. The rotating element 17 can also support a single shaft 55, that is, have a single axis B-B and a counterweight on the part opposite the axis B-B with respect to the axis A-A, rather than a pair of axes B-B and C-C with relative pairs of disc blades. In this case, the machine productivity will in any case be double compared to normal machines with a single blade, or productivity can be kept the same or slightly increased compared to that of single blade machines, reducing the mechanical stress on the machine parts and on the material to be cut by reducing the rotation speed of the rotating element.

Unlike the illustration in the drawings, it would also be possible to take up wear of the cutting blades 19A, 19B and optionally 20A, 20B by moving the whole head, or rotating element 17 downwards, i.e. towards the logs L being fed, rather than moving the axes B-B and C-C of rotation of the disc blades radially with respect to the axis A-A.

The reciprocal distance of the two blades 19A, 19B or 20A, 20B of each pair can be adjusted and modified (see FIG. 2A) by replacing the mechanical locking elements of said blades on the respective shaft 55.

FIGS. 6 to 9 show a modified embodiment of the cutting machine according to the invention, in which a specific configuration is indicated to adjust the reciprocal position of the blades 19A, 19B and 20A, 20B of each pair of blades. The same numbers indicate the same or equivalent parts to those illustrated in the previous figures.

In this embodiment the rotating element 17 is composed of two plates 17A and 17B parallel and rigidly connected to each other. By means of bearings 57 (FIG. 9) shafts 55 are supported on the two plates 17A, 17B, said shafts in turn supporting the two blades 19B and 20B and keyed onto which are toothed pulleys 59 for the toothed belt 61.

The plate 17B also supports the two sharpening units 87 for the two blades 19B and 20B. Contrary to the case of the previous embodiment, in this case the two sharpening units 87 are moving on guides 83 integral with the plate 17B rather than supported by a slide. The movement of the sharpening units 87 towards and away from the grinding wheels 19B, 20B is controlled by actuators 89 by means of threaded bars 91 and female screws 93 as described in the previous embodiment.

The plate 17B supports a splined profile 101, which extends parallel to the axis of rotation A-A of the rotating element 17. A third plate 17C, extending parallel to the plates 17A and 17B and rotating integral therewith about the axis A-A, is axially adjustable on the splined profile 101. The plate 17C can be locked on the splined profile 101 by means not shown and of a type known per se.

Figure 9:
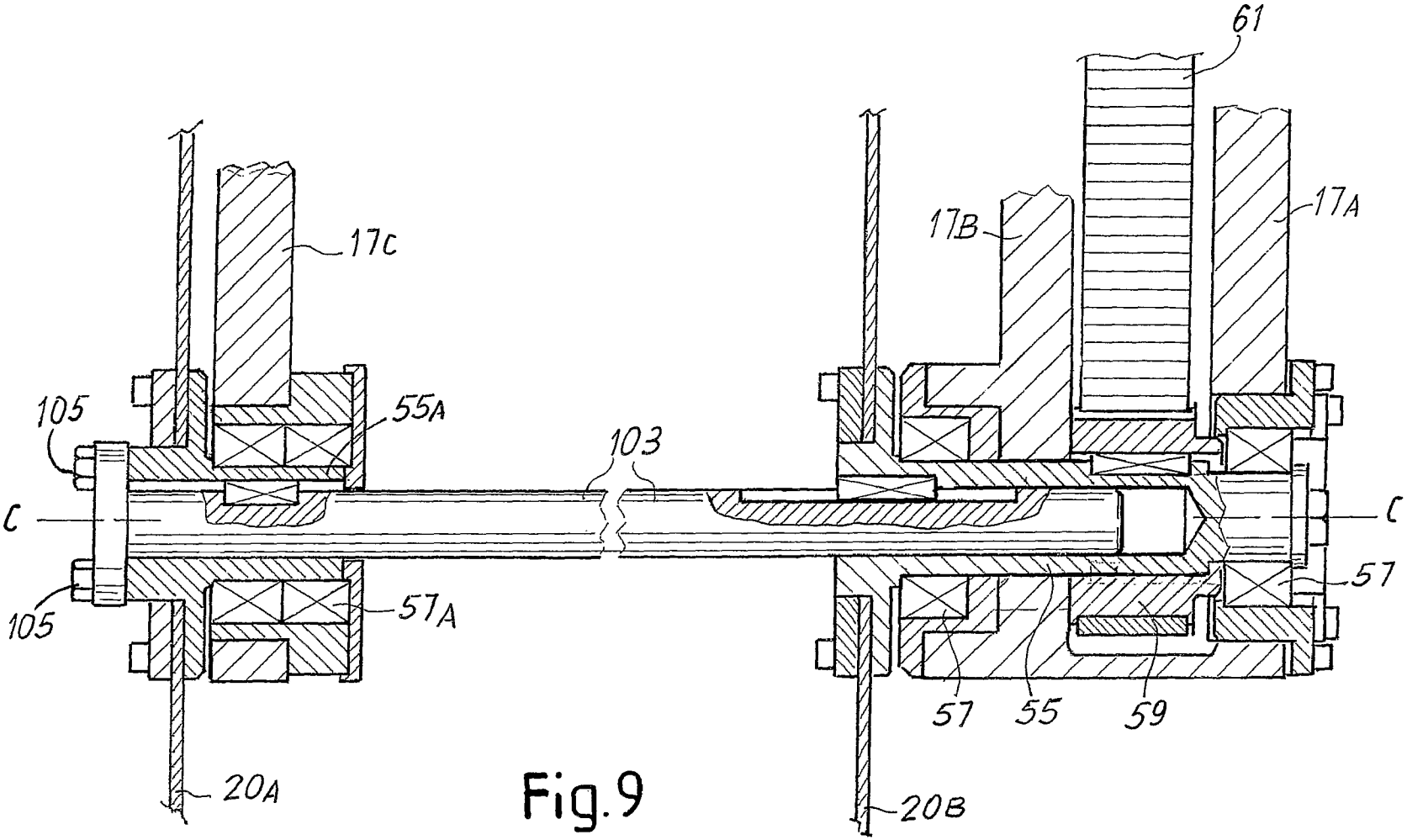
FIG. 9 shows a detail of the assembly system of one of the two pairs of blades.

The blades 19A and 20A, coaxial with the blades 19B and 20B respectively, are supported on the plate 17C. Each blade 19A, 20A is supported by a hollow hub 55A by means of bearings 57A (FIG. 9). Inserted inside each of the two hollow hubs 55A is a respective shaft 103 torsionally coupled by means of screws 105 to said hub and therefore to the respective blade 19A or 20A. Each shaft 103 is inserted slidingly in the shaft 55 (also hollow like the hub 55A) supporting the corresponding blade 19B or 20B.

A key or splined profile coupling between the hollow shaft or hub 55 and the shaft 103 allows rotational motion of the blade 19B or 20B (supplied by the toothed belt 61) to be transmitted to the corresponding blade 19A or 20A. Moreover, relative axial sliding between the components 55 and 103 allows adjustment of the reciprocal distance between the blades 19A, 19B and 20A, 20B. Therefore, the cutting length defined by the distance between the blades 19A and 19B or 20A and 20B of each pair of blades can be adjusted by releasing the plate 17C and sliding it along the grooved profile 101 and then locking it in the desired position, while the shafts 103 sliding in the hollow shafts or hubs 55 maintain the torsional coupling between the two blades of each pair.

This makes it possible to rapidly modify the cutting length.

Adjustment of the distance between the plate 17C and the plates 17A, 17B can also be obtained by means of an actuator, for example with a screw and nut system controlled by a servomotor.

The plate 17C can also be supported with a different system than the splined profile 101, such as by means of a pair of guide columns orthogonal to the plates 17A, 17B, 17C and parallel to the axis A-A.

Supported on the plate 17C are the sharpening units 85 of the blades 19A and 20A, which move along guides 81 integral with the plate 17C by means of actuators 89 and screw and nut transmissions 91, 93, in exactly the same way as indicated for the sharpening units 87 supported by the plate 17B. This offers the advantage of the sharpening units 85 of the blades 19A and 20A being adjusted in a position integral with and simultaneously to the respective blades 19A, 20A when the cutting length is modified.

The rotating element 17 comprising the three plates 17A, 17B and 17C is gradually lowered with respect to the path of the rolls or logs L to be cut to compensate the reduction in diameter of the cutting disc blades due to wear and subsequent sharpening operations.

It is understood that the drawing merely shows a practical embodiment of the invention, which may vary in shapes and arrangements without however departing from the scope of the concept on which the invention is based. Any reference numbers in the appended claims are provided purely to facilitate reading of said claims with reference to the description and the accompanying drawing, and do not limit the scope of protection represented by the claims.

The invention claimed is:

1. A cutting machine for cutting elongated products into articles of a predetermined length, comprising (a) a feed path along which said elongated products are advanced toward a cutting head; (2) at least one pusher constrained to a flexible member for pushing said elongated products along said feed path towards said cutting head; and (3) a cutting head comprising at least one cutting tool rotating about an axis of rotation and moving cyclically, wherein said at least one cutting tool comprises at least two disc blades which are rotatable about a common rotation axle and are spaced apart by said length, wherein a first blade of said at least two disc blades is supported by a first plate and a second blade of said at least two disc blades rotatable about said common rotation axle with the first blade is supported by a second plate, distance between said first plate and said second plate being adjustable to adjust distance between said at least two disc blades; and a rotating element supported by a rotating shaft and on which said common rotation axle of said at least two disc blades is supported, the at least two disc blades moving along a substantially circular orbit about an axis of the rotating shaft, wherein said first plate and said second plate form part of said rotating element, and wherein the first plate is supported by said rotating shaft and the second plate is torsionally constrained to the first plate to rotate integral therewith and with said rotating shaft.

2. The cutting machine as claimed in claim 1, wherein said common rotation axle transmits motion from the first blade supported by the first plate to the second blade supported by the second plate.

3. The cutting machine as claimed in claim 1, wherein said first plate comprises two plate elements rigidly connected to each other.

4. A cutting machine for cutting elongated products into articles of a predetermined length, comprising at least one cutting tool rotating about an axis of rotation and moving cyclically, wherein said at least one cutting tool comprises at least two disc blades which are rotatable about a common rotation axle and are spaced apart by said length, wherein a first blade of said at least two disc blades is supported by a first plate and a second blade of said at least two disc blades rotatable about said common rotation axle with the first blade is supported by a second plate, distance between said first plate and said second plate being adjustable to adjust distance between said at least two disc blades, wherein said first plate and said second plate each support a sharpening unit respectively for the first blade and for the second blade rotating about said common rotation axle.

5. The cutting machine as claimed in claim 4, wherein each said sharpening unit associated with the first blade and the second blade rotating about said common rotation axle move along directions of motion angularly staggered from each other towards and away from respective blades.

6. The cutting machine as claimed in claim 5, wherein the directions of motion of each said sharpening unit towards and away from the first blade and the second blade rotating about the common rotation axle are positioned so as to define an angle, a bisector of said angle being represented by a straight line orthogonal to an axis of a main rotating shaft of a rotating element and to the common rotation axle of the at least two disc blades.

7. A cutting machine for cutting elongated products into articles of a predetermined length, comprising at least one cutting tool rotating about an axis of rotation and moving cyclically, wherein said at least one cutting tool comprises at least two disc blades which are rotatable about a common rotation axle and are spaced apart by said length, wherein a first blade of said at least two disc blades is supported by a first plate and a second blade of said at least two disc blades rotatable about said common rotation axle with the first blade is supported by a second plate, distance between said first plate and said second plate being adjustable to adjust distance between said at least two disc blades; and a further cutting tool rotating about a further axis of rotation, said further cutting tool comprising a third blade and a fourth blade, and wherein said first plate supports said third blade and a said second plate supports said fourth blade; said at least one cutting tool and said further cutting tool moving along a common path.

8. The cutting machine as claimed in claim 7, wherein said first plate supports first sharpening units for each said first blade, and the third blade and the second plate supports second sharpening units for each said second blade and said fourth blade.

9. A cutting machine for cutting elongated products into articles of a predetermined length, comprising at least one cutting tool rotating about an axis of rotation and moving cyclically, wherein said at least one cutting tool comprises at least two disc blades which are rotatable about a common rotation axle and are spaced apart by said length, wherein a first blade of said at least two disc blades is supported by a first plate and a second blade of said at least two disc blades rotatable about said common rotation axle with the first blade is supported by a second plate, distance between said first plate and said second plate being adjustable to adjust distance between said at least two disc blades, wherein said common rotation axle of the first blade and second blade of said at least one cutting tool is supported by bearings on the first plate and on the second plate.

10. A cutting machine for cutting elongated products into articles of a predetermined length, comprising at least one cutting tool rotating about an axis of rotation and moving cyclically, wherein said at least one cutting tool comprises at least two disc blades which are rotatable about said axis of rotation and are spaced apart by said length, wherein a first blade of said at least two disc blades is supported by a first plate and a second blade of said at least two disc blades rotatable about a common axis with the first blade is supported by a second plate, distance between said first plate and said second plate being adjustable to adjust distance between said at least two disc blades; wherein said first plate comprises two plate elements rigidly connected to each other; wherein a shaft supporting the first blade and second blade of said at least one cutting tool is supported by bearings on the two plate elements.

11. The cutting machine as claimed in claim 10, wherein keyed on said shaft is a toothed pulley for a toothed belt, which is arranged between the two plate elements, said toothed belt transmitting rotary motion to said shaft and said first blade and said second blade.

12. A cutting machine for cutting elongated products into articles of a predetermined length, comprising at least one cutting tool rotating about an axis of rotation and moving cyclically, wherein said at least one cutting tool comprises at least two disc blades which are rotatable about said axis of rotation and are spaced apart by said length, wherein a first blade of said at least two disc blades is supported by a first plate and a second blade of said at least two disc blades rotatable about a common axis with the first blade is supported by a second plate, distance between said first plate and said second plate being adjustable to adjust distance between said at least two disc blades, wherein said first plate supports a splined profile, and wherein said second plate is axially adjustable on said splined profile.

13. A cutting machine for cutting elongated products into articles of a predetermined length, comprising at least one cutting tool rotating about an axis of rotation and moving cyclically, wherein said at least one cutting tool comprises at least two disc blades which are rotatable about a common rotation axle and are spaced apart by said length, wherein a first blade of said at least two disc blades is supported by a first plate and a second blade of said at least two disc blades rotatable about said common rotation axle with the first blade is supported by a second plate, distance between said first plate and said second plate being adjustable to adjust distance between said at least two disc blades; a rotating element supported by a rotating shaft and on which said common rotation axle of said at least two disc blades is supported, the at least two disc blades moving along a substantially circular orbit about an axis of the rotating shaft; and at least one feed channel of the products to be cut and feed members which, for each said orbit of said disc blades, moves the products forward by two lengths or by a multiple equivalent to lengths of said articles.

* * * * *